US005616295A

United States Patent [19]

Tawara et al.

[11] Patent Number: 5,616,295

[45] Date of Patent: Apr. 1, 1997

[54] FLOATING FURNACE

[75] Inventors: Hiroshi Tawara, Nagoya; Mineyuki Hiramatsu, Mie-ken; Jun Maeda, Nagoya, all of Japan

[73] Assignee: Daidotokushuko Kabushikikaisha, Japan

[21] Appl. No.: 587,113

[22] Filed: Jan. 11, 1996

[30] Foreign Application Priority Data

Jan. 13, 1995 [JP] Japan ..... 7-21227

[51] Int. Cl.[6] ..... C21D 1/74

[52] U.S. Cl. ..... 266/92; 266/111; 266/103

[58] Field of Search ..... 266/78, 92, 103, 266/111; 148/508

[56] References Cited

U.S. PATENT DOCUMENTS 3,328,997 7/1967 Beggs et al. ..... 266/103

5,118,366 6/1992 Shintaku ..... 266/111

5,360,203 11/1994 Yamamoto et al. ..... 266/111

*Primary Examiner*—Scott Kastler

*Attorney, Agent, or Firm*—William A. Drucker

[57] ABSTRACT

In the furnace a plurality of floaters are arranged in series in a direction in which the metal strip is transferred. The strip is fed through the furnace, floated by these floaters. A test floater is installed along the strip transfer pathway. The height of the strip floated by the test floater is detected by a float sensor. The gas pressure of the test floater detected when the test floater floats the strip to an appropriate height is reflected on the gas pressures of the in-furnace floaters. As a result, the in-furnace floaters float the strip to the appropriate height.

5 Claims, 3 Drawing Sheets

FLOATING FURNACE

TECHNICAL FIELD

The present invention relates to a floating furnace for heat-treating a metal strip that is being transferred through the furnace, floated by the pressure of gas blown out of a plurality of floaters arranged in series in the furnace.

BACKGROUND ART

The floating furnace has a series of floaters arranged therein in the direction of transfer, each of which blows gases such as hot air or cold air to float the strip, thereby continuously transferring the strip, contact-free, through the furnace and at the same time heat-treating it with the gas.

The gas pressure of the floaters used in this kind of floating furnace has conventionally been determined by calculating a theoretical gas pressure necessary to float the strip taking into account the thickness, width and specific gravity (kind of steel) (in this specification, it is also called shape conditions) of the strip and then air volume of floater blowers has been controlled so that the floaters in the furnace can maintain that gas pressure.

In the floating furnace that performs such a control, not only is the calculation, based on a variety of conditions such as thickness, width and specific gravity, complicated but also there is a possibility of artificial errors that during the calculating process these conditions may be incorrectly measured or the resultant figures erroneously entered. These artificial errors will make the floating of a strip inappropriate, leading to damages to the strip due to contact with members in the furnace. This causes lowering of the reliability that the strip can be heat-treated without a damage.

Another problem is that every time a metal strip to be heat-treated is changed in shape condition, a theoretical pressure necessary for floating needs to be calculated and the resultant value preset, rendering the control even more complex.

Further, when metal strips with greatly differing shape conditions are connected for continuous heat treatment in the furnace, the conventional floating furnace has the following problem. When the boundary of the two strips passes through the furnace, if the gas pressure of the in-furnace floaters are set to that used for the preceding strip, the front end portion of the succeeding strip floats too high or too low. Conversely, when the gas pressure is set for the succeeding strip, the floating height of the rear end portion of the preceding strip becomes too low or too high. As a result, the front or rear end portion of the strips may contact the members in the furnace and be damaged.

SUMMARY OF THE INVENTION

It is therefore an object of this invention to provide a floating furnace that can continuously heat-treat strips without causing any damage.

Another object is to enable easy setting of appropriate floating of the strip.

A further object is to enhance the reliability for heat-treating the strip without causing damages.

A further object is to make it possible to transfer a series of strips, widely differing in shape conditions from each other and connected to each other, without causing a damage to the rear end portion of the preceding strip or the front end portion of the succeed stingrip when the series of strips is continuously passed through the furnace for heat treatment.

The floating furnace according to the invention is a floating furnace comprising: a furnace; and a plurality of in-furnace floaters arranged in the furnace in series in a direction in which a metal strip is transferred; wherein the strip is transferred through the furnace, with floated by the gas coming out of the in-furnace floaters; further comprising: a test floater installed along the strip transfer pathway; a float sensor to detect a height of the strip floated by a gas blown from the test floater; and a gas pressure matching means to make the gas pressures of the infurnace floaters match the gas pressure of the test floater when the test floater floats the strip to an appropriate height.

In the floating furnace of this invention, the strip is floated by a trial or test floater and the height of the floated strip is detected by a floating sensor. The gas pressure of the floaters in the furnace is made to follow the gas pressure of the test floater that floats the strip to an appropriate height. This allows setting of the floating condition to be made according to the shape conditions of each strip.

Because the strip is actually floated by the test floater, whose working conditions are followed by infurnace floaters, there is no room for artificial errors to occur as there is with the conventional technology, with the result that the reliability of the heat treatment without causing any damage to the strip is enhanced.

Further, where a plurality of strips with widely differing shape conditions are connected and continuously passed through the furnace for heat treatment, it is possible to change the gas pressure of each in-furnace floater as the boundary of the strips arrives at the floater. Hence, it is possible to set the rear end portion of the preceding strip and the front end portion of the succeeding strip at appropriate floating states and to continuously heat-treat the both strips without damaging them.

Other objects and advantages of the invention will become apparent during the following discussion of the accompanying drawings.

DESCRIPTION OF THE PREFERRED EMBODIMENT

Figure 1:
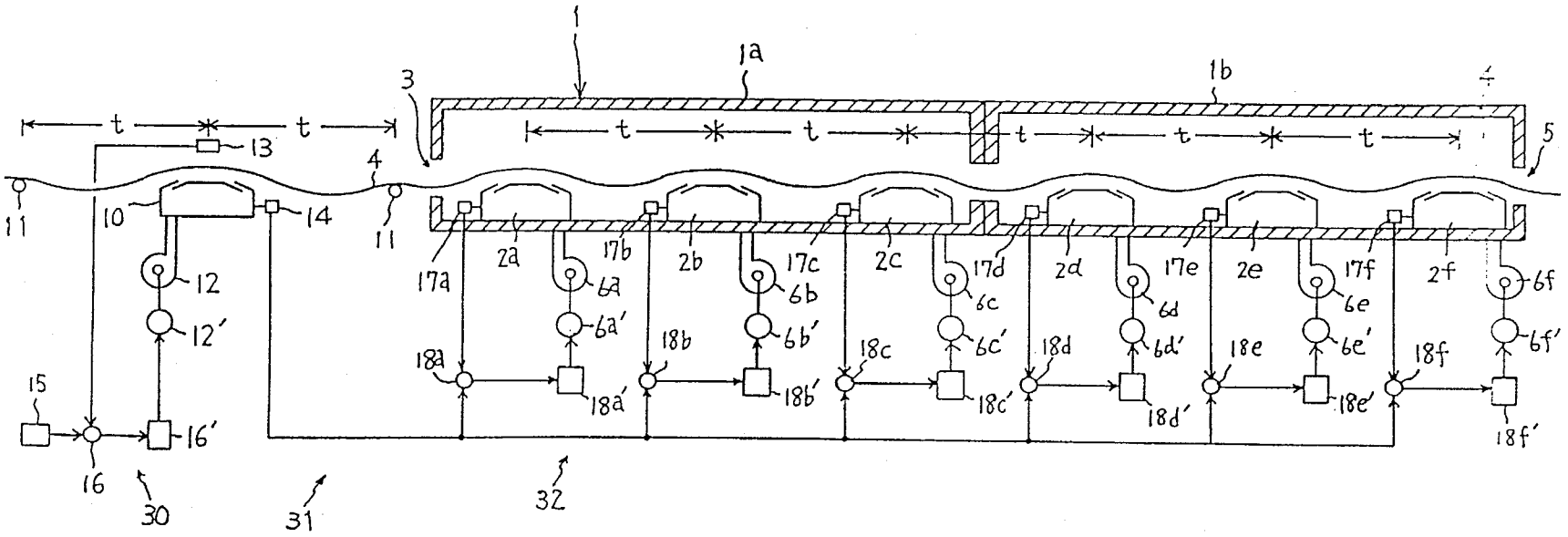
FIG. 1 is a control system diagram showing one embodiment of the floating furnace.

One embodiment of this invention will now be described by referring to the accompanying drawings. FIG. 1 shows a floating furnace and a gas pressure control system for floaters installed in the furnace. In the figure, reference numeral 1 represents a commonly known continuous furnace in which a plurality of floaters 2*a*–2*f* are arranged along the length of the furnace at a constant pitch t. A metal strip is transferred in the direction of furnace length. That is, the direction of the furnace length is the direction of transfer of metal strip. The furnace 1 has, for example, a heating chamber la and a cooling chamber 1*b*. Both of these chambers may be heating chambers with different heating temperatures. Reference numeral 3 designates a supply port at one end of the floating furnace into which the metal strip 4 is loaded. Reference numeral 5 designates a discharge port at the other end of the floating furnace. Blowers 6*a*–6*f* that supply floating gas to floaters 2a–2f are driven by inverter motors 6a'–6f' so that the amount of air blown is variable. By changing the amount of air supplied by the blowers, the pressure in the in-furnace floaters 2a–2f as well as the pressure of the gas blown from them can be correspondingly changed respectively.

Figure 2:
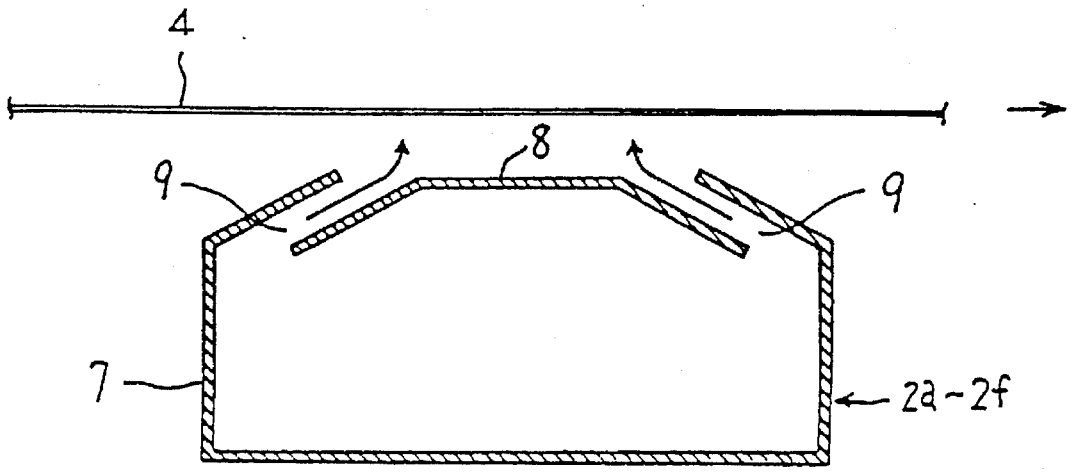
FIG. 2 is an enlarged cross section of the floater in the floating furnace of FIG. 1.

As shown in the cross section of FIG. 2, the floaters 2a–2f each have a chamber 7 to receive air supplied from the blower 6a–6f. Provided at the top of the chamber 7 is a horizontal plate 8 that has inwardly inclined slit like nozzles 9 formed at its peripheral portion, from which gas is blown against the underside of the strip 4 to float it.

Reference numeral 10 designates a test floater constructed similarly to the in-furnace floaters 2a–2f. The test floater 10 is installed in a strip transfer passage in front of the supply port 3 of the continuous furnace 1. Rollers 11, 11, which are installed before and after the test floater 10 at the same pitch t from the test floater as that of the in-furnace floaters 2a–2f, support the strip 4 so as to make the conditions of the test floater 10 for floating the strip 4 equal to those of the in-furnace floaters 2a–2f. A blower 12 is driven by an inverter motor 12' to supply a variable amount of gas to the test floater 10. By changing the amount of gas supplied, the gas pressure in the test floater 10 as well as the pressure of gas flowing out of the test floater can be changed correspondingly. Reference numeral 13 designates a float sensor that measures the height of the strip 4 floated by the gas blown from the test floater 10. Reference numeral 14 designates a pressure sensor to detect the gas pressure in the test floater 10.

A control means 30 for the test floater controls the gas pressure of the test floater 10 so that the detected value from the float sensor 13 is equal to a preset height. It comprises members denoted 15, 16 and 16'. A setter 15 is used to set a desired height of he floated strip 4. A comparator 16 compares the detected height from the float sensor 13 and the height set by the setter 15 and outputs a differential signal. A control let 16' controls the motor 12' in response to the signal from the comparator 16.

The setter 15 is set with a desired floating height that allows a stable transfer of the strip 4 through the continuous furnace 1. The float sensor 13 detects the height of the strip 4 floated by the gas blowing from the test floater 10. The comparator 16 compares the detected height from the float sensor 13 with the set height from the setter 15 and outputs a differential signal. The controller 16' controls the motor 12' in response to the signal from the comparator 16. By controlling rotation of the motor 12', the gas pressure in the test floater 10 is determined to a pressure corresponding to the rotation of the motor 12' and the pressure of the gas blown from the test floater 10 is determined to the corresponding pressure. The height of the strip 4 floated by the test floater 10 corresponds to the pressure of the blowing gas and is detected by the float sensor 13. These actions are carried out in the same way as in a normal feedback process and the strip 4 is floated to the desired floating height set by the setter 15.

The gas pressure in the test floater 10 when the strip 4 is floated at the desired height is detected by the pressure sensor 14.

A gas pressure matching means 31 causes the gas pressures of the in-furnace floaters 2a–2f to be equal to the gas pressure of the test floater 10 and is shown, for example, to comprise the pressure sensor 14 and a control means 32 described next. The control means 32 controls the air flow of the blowers 6a–6f so that the gas pressures of the in-furnace floaters 2a–2f are equal to the detected pressure from the pressure sensor 14. The details of the control means 32 are given here. Pressure sensors 17a–17f detect the gas pressures inside the in-furnace floaters 2a–2f. Comparators 18a–18f each compare the signal from the pressure sensor 14 and the signals from the pressure sensors 17a–17f and output their differential signals. Controllers 18a'–18f' control motors 6a'–6f' according to the differential signals from the comparators 18a–18f. The gas pressures in the in-furnace floaters 2a–2f correspond to the rotation of the motors 6a'–6f' and are detected by the pressure sensors 17a–17f which feed back the detected pressures to the comparators 18a–18f. Hence, the gas pressures in the in-furnace floaters 2a–2f become equal to the detected pressure from the pressure sensor 14, i.e., the gas pressure in the test floater 10.

The control means 32 in the above embodiment is shown to control the in-furnace floaters 2a–2f individually. It is possible to provide only one set of the pressure sensor 17a, comparator 18a and controller 18a' and to control all the blower motors 6a'–6f' in the same way by the controller 18a'.

In the continuous furnace 1 there are installed a heat source and a cooler, though not shown, to heat-treat the strip 4 according to the specified temperature curve.

In such a floating furnace, the strip 4 is floated to a preset height by controlling the gas pressure of the test floater 10 and, based on the gas pressure of the test floater 10, the gas pressures of the floaters 2a–2f in the continuous furnace 1 are determined. Hence, if the test floater 10 and the in-furnace floaters 2a–2f have the same structure, the floating height of the strip 4 attained by the test floater 10 and the floating height of the strip 4 floated by the in-furnace floaters 2a–2f are equal. Therefore, once the specified floating height is set in the setter 15, the strip 4 is automatically maintained at an appropriate height with high precision in the furnace without having to adjust the air flow to the in-furnace floaters 2a–2f each time the kind or shape of the strip 4 changes. As a result, a stable transfer is assured at all times. Further, because the test floater 10 is located at the foremost position in the strip transfer pathway, once the strip 4 is set to an appropriate height by the test floater 10, the heights of the strip 4 attained by the in-furnace floaters 2a–2f will automatically follow that appropriate height. In this way, the strip 4 can be reliably protected against damage.

In the above embodiment, the test floater 10 is located in front of the supply port 3 of the continuous furnace 1. This location is free from the thermal influences of the furnace and therefore the float sensor 13 and the pressure sensor 14 do not require heat resisting capability, reducing their costs.

The test floater 10 may be located inside the furnace immediately after the supply port 3. When there is a room inside the furnace, installing the test floater 10 at such a location eliminates the need for securing an additional space outside the furnace.

Figure 3:
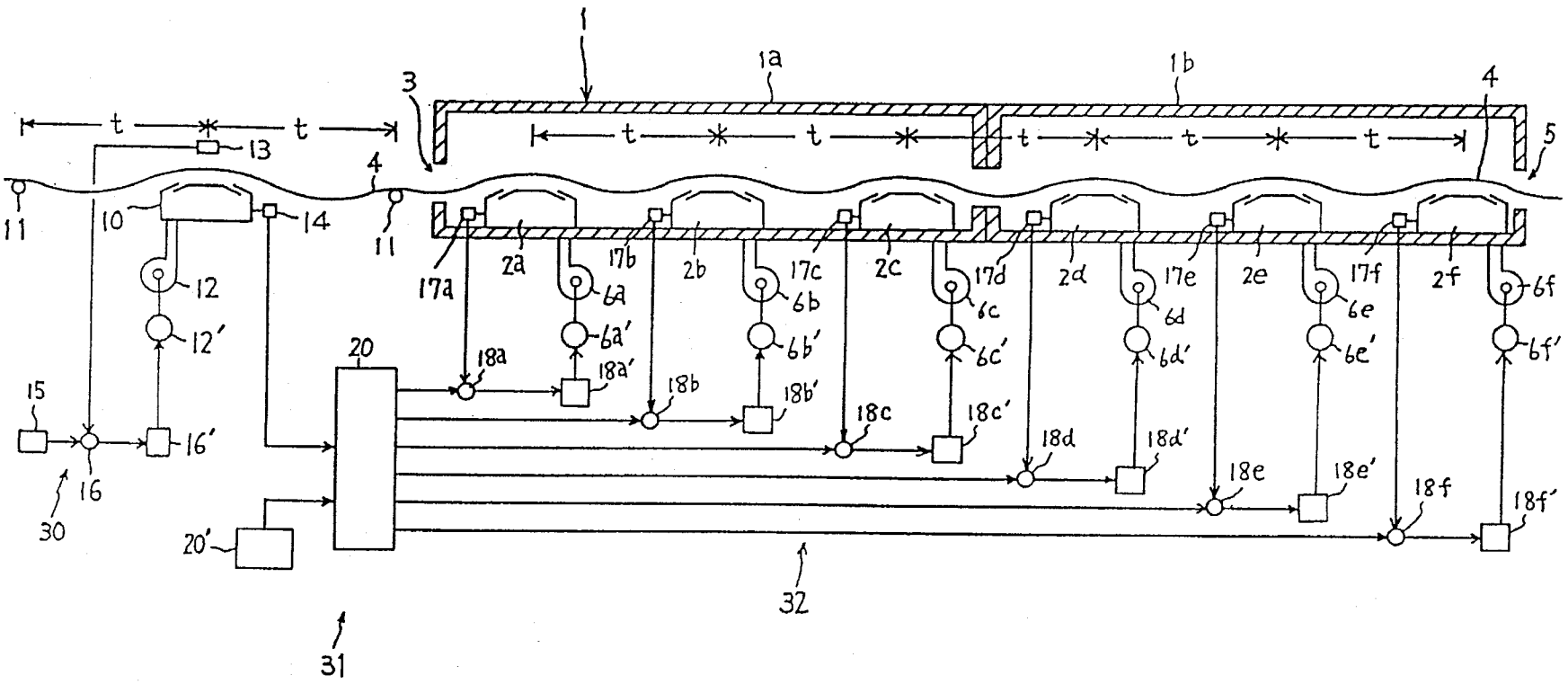
FIG. 3 is a control system diagram showing another embodiment of the floating furnace.

FIG. 3 shows another example of the continuous furnace which allows connected metal strips with different shape conditions to be passed continuously through the furnace for heat treatment without damaging the rear end portion of the preceding strip and the front end portion of the succeeding strip. In this example, the gas pressure matching means 31 has a time differential control means 20 that controls the gas pressure of each floater 2a–2f in the continuous furnace 1 with a time lag that varies with the movement of the strip 4. A setter 20' is used to set the speed at which the strip 4 is moved. The time differential control means 20 delays the signal from the pressure sensor 14 successively by as much time as it takes for the strip, which has passed the test floater 10, to reach each of the in-furnace floaters 2*a*–2*f*, and then feeds the delayed signals to the respective comparators 18*a*–18*f*. These times are calculated by the time differential control means 20 based on the distance, preset in the control means 20, between the test floater 10 and the in-furnace floater 2a, the pitches between the infurnace floaters 2*a*–2*f*, and the strip feeding speed set in the setter 20'.

The control of the in-furnace floaters equipped with the above-mentioned time differential control means 20 is performed as follows. When a junction (boundary) of strips 4 with different thicknesses passes the test floater 10, the gas pressure of the test floater 10 is changed by the test floater control means 30 so that the floating height detected by the float sensor 13 is equal to the preset height. As a result, the gas pressure detected by the pressure sensor 14 changes. The time differential control means 20 receives the changed pressure signal. The time differential control means 20 then delays the pressure signal by the amount of time it takes for the junction to reach the in-furnace floater 2*a*, and hereafter sends the pressure signal to the comparator 18*a*. Next, after delaying the pressure signal by the amount of time it takes for the junction to reach the in-furnace floater 2*b*, the time differential control means 20 sends it to the comparator 18*b*. Similarly, the pressure signal is sent to other comparators 18*c*–18*f* after being delayed by the length of time taken by the junction to reach the floaters 2*c*–2*f*.

The gas pressures of the in-furnace floaters 2*a*–2*f* therefore are changed when the junction arrives at the respective floaters. Hence, each floater blows an appropriate pressure of gas to the rear end portion of the preceding strip and to the front end portion of the succeeding strip, so that both the rear end portion of the preceding strip and the front end portion of the succeeding strip are kept in appropriate floating conditions and transferred through the furnace without being damaged.

Components, whose functions are considered equal to or identical with those of the preceding figures, are assigned like reference numerals is, and the repetitive explanations are omitted.

As many apparently widely different embodiments of this invention may be made without departing from the spirit and scope thereof, it is to be understood that the invention is not limited to the specific embodiments thereof except as defined in the appended claims.

What is claimed is:

1. A floating furnace comprising:

(a) a furnace; and (b) a plurality of in-furnace floaters arranged in the furnace in series in a direction along a strip transfer pathway in which a metal strip is to be transferred; wherein the strip is transferred through the furnace floating on the gas coming out of the in-furnace floaters;

further comprising:

(c) a test floater disposed along the strip transfer pathway;

(d) a setter for setting a predetermined height of a floated strip above said floaters;

(e) a float sensor to detect the height of the strip floating by a gas blown from the test floater;

(f) a comparator to compare the detected height from said float sensor and the height set by said setter; and (e) gas pressure matching means to make the gas pressures of the in-furnace floaters match the gas pressure of the test floater when the test floater floats the strip at said predetermined height.

2. A floating furnace according to claim 1, wherein the gas pressure matching means comprises:

a pressure sensor to detect a gas pressure of the test floater; and a control means to control the gas pressures of the in-furnace floaters in such a way as to make them match the gas pressure of the test floater detected by the pressure sensor.

3. A floating furnace according to claim 1, wherein the test floater is installed in front of a supply port of the furnace.

4. A floating furnace according to claim 1, wherein the test floater is installed immediately after a supply port of the furnace.

5. A floating furnace according to claim 1, wherein the gas pressure matching means includes a time differential control means, which controls the gas pressures of the in-furnace floaters individually with a time delay that varies with the movement of the strip.

* * * * *